US006123256A

United States Patent [19]

Landis

[11] Patent Number: 6,123,256

[45] Date of Patent: Sep. 26, 2000

[54] ENVELOPE CONSTRUCTION

[76] Inventor: William J. Landis, 3823 Grant St., Reading, Pa. 19606

[21] Appl. No.: 09/267,092

[22] Filed: Mar. 12, 1999

[51] Int. Cl.[7] ..... B65D 27/38

[52] U.S. Cl. ..... 229/311

[58] Field of Search ..... 229/309, 310, 229/311, 312

[56] References Cited

U.S. PATENT DOCUMENTS

| | | | |
|---|---|---|---|
| 1,328,028 | 1/1920 | Ahana | 229/311 |
| 1,957,684 | 5/1934 | Will | 229/312 |
| 3,104,048 | 9/1963 | Lemiesz | 229/311 |
| 3,178,097 | 4/1965 | Topetchy . | |
| 3,370,782 | 2/1968 | Hickman . | |
| 3,392,908 | 7/1968 | Shelley et al. | 229/309 |
| 3,655,120 | 4/1972 | Stern . | |
| 4,781,296 | 11/1988 | Morris et al. | 229/309 X |
| 4,795,035 | 1/1989 | Kim . | |
| 5,505,376 | 4/1996 | Kent et al. | 229/311 |

FOREIGN PATENT DOCUMENTS

| | | | |
|---|---|---|---|
| 38829 | 6/1928 | Denmark | 229/311 |
| 402019 | 9/1909 | France | 229/311 |
| 500898 | 3/1920 | France | 229/311 |
| 1457624 | 9/1966 | France | 229/311 |
| 29 02 997 | 8/1980 | Germany | 229/311 |
| 580552 | 8/1958 | Italy | 229/311 |

*Primary Examiner*—Jes F. Pascua
*Attorney, Agent, or Firm*—Henderson & Sturm LLP

[57] ABSTRACT

An improved envelope construction comprises in general an envelope unit, a sealing unit, and a tear strip unit. The envelope unit comprises an envelope body member having a flap portion with a central segment provided with the sealing unit and two generally triangular end segments separated from the central segment by strips of perforations. The sealing unit and the tear strip unit are operatively disposed on the flap portion. The tear strip unit extends across and has a length that can project beyond the flap portions. The opposite ends of the tear strip member are provided with globular elements to facilitate the user's grasp of a selected end of the tear strip to open the envelope.

1 Claim, 1 Drawing Sheet

ENVELOPE CONSTRUCTION

BACKGROUND OF THE INVENTION

1. Field of the Invention

The present invention relates to the field of envelope constructions in general, and in particular to envelope constructions having built in tear strips incorporated into the envelope construction.

2. Description of Related Art

As can be seen by reference to the following U.S. Pat. Nos. 3,178,097; 3,370,782; 3,644,120, and 4,795,035, the prior art is replete with myriad and diverse envelopes having a built in mechanism for facilitating the opening of a sealed envelope.

While all of the aforementioned prior art constructions are more than adequate for the basic purpose and function for which they have been specifically designed, they are uniformly deficient with respect to their failure to provide a simple, efficient, and practical arrangement to allow a person to open a sealed envelope from either end of the envelope.

As most people are generally aware, and left handed people are particularly aware, most self-opening envelope constructions are specifically designed to favor right handed individuals in that the tag or starting end of the severing strip is normally positioned on only one and that end favors a right hand dominant opening or tearing motion.

As a consequence of the foregoing situation, there has existed a longstanding need for a new and improved type of envelope construction wherein the tear strip can be grasped from either end of the envelope construction depending on the choice of the person opening the envelope, and the provision of such a construction is a stated objective of the present invention.

BRIEF SUMMARY OF THE INVENTION

Briefly stated, the improved envelope construction that forms the basis of the present invention comprises in general an envelope unit, a sealing unit, and a tear strip unit. The envelope unit comprises an envelope body member having a flap portion. The sealing unit and the tear strip unit are operatively disposed on the flap portion.

As will be explained in greater detail further on in the specification, the flap portion has a central segment that is provided with the sealing unit and two generally triangular end segments that are separated from the central segment by strips of perforations such that the end segments can be selectively detached from the central segment.

In addition, the tear strip unit comprises an elongated tear strip member which extends across and has a length that can project beyond the flap portion. The opposite ends of the tear strip member are further provided with globular elements that will facilitate the user's grasp of a selected end of the tear strip member to open the sealed envelope construction either from the upper right hand or upper left hand corner of the envelope construction.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
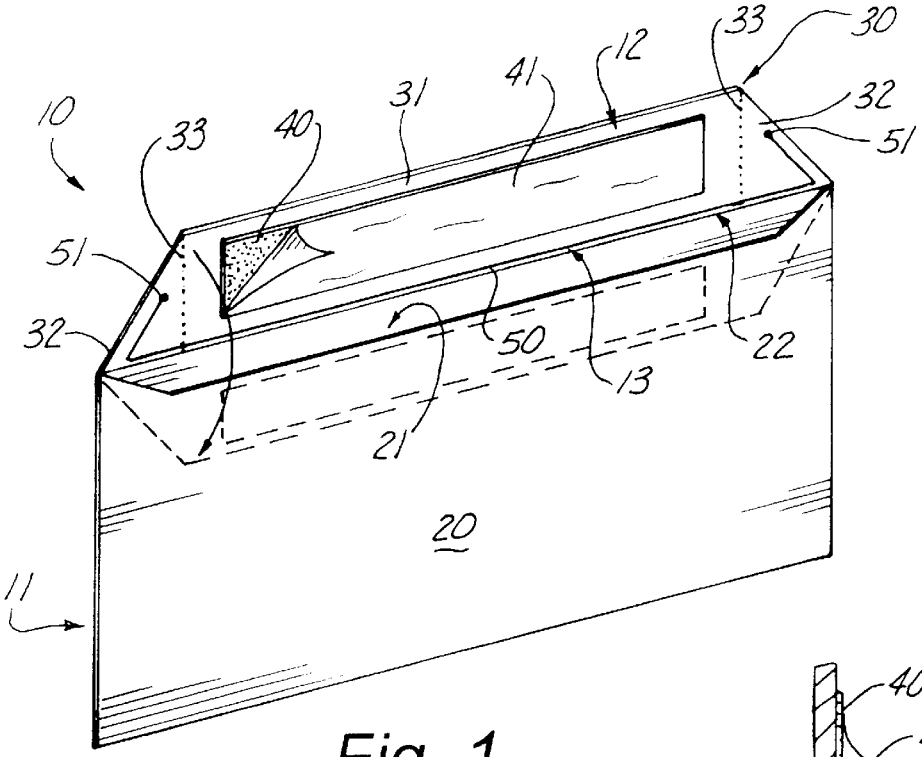
FIG. 1 is a perspective view of the envelope construction in the unsealed condition.

As can be seen by reference to the drawings, and in particular to FIG. 1, the improved envelope construction that forms the basis of the present invention is designated generally by the reference number 10. The construction 10 comprises in general an envelope unit 11, a sealing unit 12, and a tear strip unit 13. These units will now be described in seriatim fashion.

As can best be seen by reference to FIG. 1, the envelope unit 11 comprises a generally rectangular envelope body member 20 provided with a flap portion 30 having an elongated central segment 31 which terminates in two angled end segments 32 which are further defined by strips of perforations 33 that permit the flap end segments 32 to be physically separated from the elongated central segment 31 of the flap portion 30 in a well recognized manner.

As shown in FIG. 1, the elongated central segment 31 of the flap portion 30 of the envelope body member 20 is dimensioned to overlie the opening 21 of the envelope body member 20 and in the preferred embodiment of the invention, the elongated central segment 31 is provided with a generally rectangular configuration. However, it is to be understood that in keeping with the teachings of this invention, the elongated central segment 31 can alternately be provided with a conventional generally triangular configuration without departing from the spirit of this invention.

Figure 2:
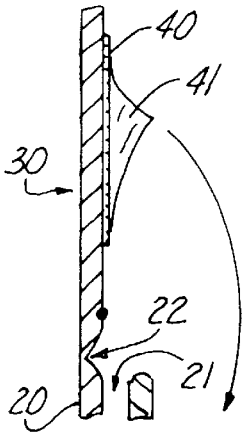
FIG. 2 is an end view of the tear strip unit and the sealing unit on the flap portion of the envelope construction.

Turning now to FIGS. 1 and 2, it can be seen that the sealing unit 12 is disposed along the elongated central segment 31 of the flap portion 30 in an orientation generally parallel to, but spaced from, the crease 22 that separates the flap portion 30 from the main part of the envelope body member 20.

It should further be noted that the sealing unit 12 does not extend from the central segment 31 to the generally triangular end segments 32 for reasons that will be explained in greater detail further on in the specification.

Furthermore, in the preferred embodiment of the invention, the sealing unit 12 comprises an elongated self sealing adhesive member 40 provided with a protective covering 41 that can be removed when it is desired to sealingly engage the flap portion 30 to the main envelope body member 20 in a well recognized fashion.

Returning once more to FIG. 1, it can be seen that the tear strip unit 13 comprises an elongated tear strip member 50 having a length greater than the length of the envelope body member 20 and fabricated from a strand of material such as nylon, polyester, or the like. The opposite ends of the tear strip member 50 are provided with a globular element 51 formed by a bead of glue or by heating and melting the ends of the synthetic material. The globular elements 51 are provided to facilitate the grasping of a selected end of the tear strip member 50 as will be explained presently.

As can also be seen by reference to FIG. 1, the intermediate portion of the tear strip member 50 is lightly glued along the entire length of the flap portion 30 at a location intermediate the crease 22 in the envelope body member 20 and the sealing unit 12 and the ends of the tear strip member 50 also lightly glued to the generally right angular shaped triangular end segments 32. The tear strip member 50 is disposed generally parallel to the base and angular face of the triangular end segments 32.

It should also be noted that this particular orientation of the end portions of the tear strip member 50 relative to the end segments 32 of the flap portion serves a dual purpose in that each end 51 of the tear strip member 50 can project beyond the ends of the envelope body member 20 when released from one of the end segments 32 of the flap portion to facilitate the grasping of the tear strip member 50 to sever the flap portion and the angular orientation of the captive end of the tear strip member 50 (e.g., under the flap segment 32 that has not been separated form the flap portion 30), virtually insures that the captive end will remain in place when the flat severing takes place.

Figure 3:
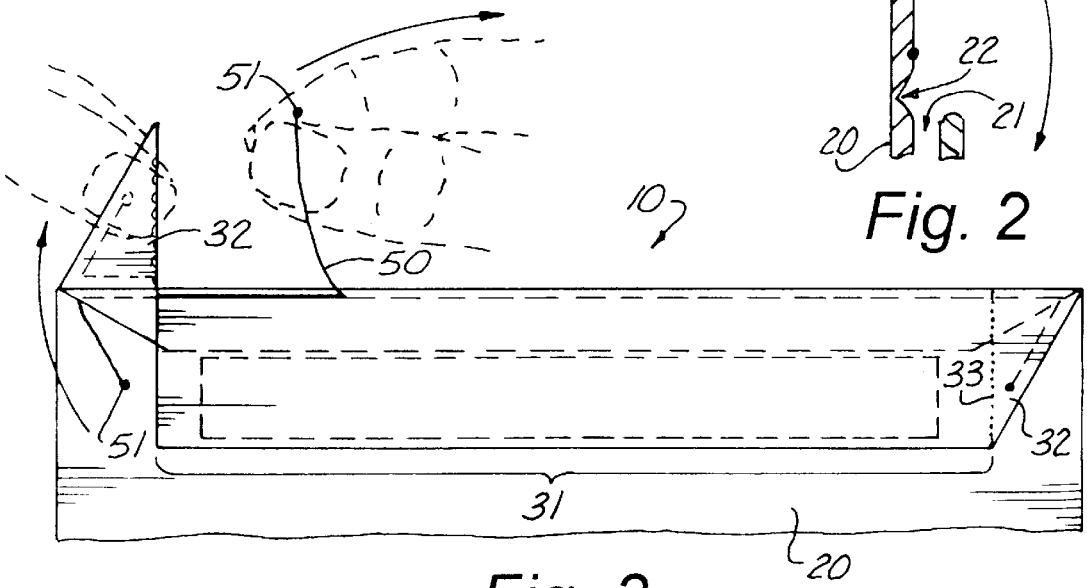
FIG. 3 is an isolated detail view showing the steps required to open the envelope from either end of the improved envelope construction.

As can best be appreciated by reference to FIG. 3, when the recipient receives the sealed envelope construction 10, they have the option to separate either the right hand flap segment 32 if they are left handed, or the left hand flap segment 32 if they are right handed so that the dominant hand will provide the pulling force on the tear strip member 50 to serve the flap portion 30 in a well recognized fashion.

Once the globular element 51 has been grasped to free the selected lightly glued end portion of the tear strip member 50 from the selected end segment 32 of the flap portion 32 an appreciable length of the tear strip member 50 will be exposed to the grasp of the user. The grasping function will be further enhanced and facilitated by the presence of the globular element 51 in a well recognized fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An improved envelope construction consisting of:

an envelope unit including an envelope body member provided with a flap portion having an elongated central segment which terminates in opposite end segments; wherein the end segments have a generally triangular configuration including an angled outer face and a sealing unit including a strip of adhesive disposed on the elongated central segment of said flap portion; and a tear strip unit operatively associated with said flap portion and including an elongated tear strip member having a length that is greater than the length of the envelope body member wherein said elongated tear strip member extends across the length of the flap portion and has opposite ends which are dimensioned to extend beyond the end segments of the flap portion and are provided with globular elements for facilitating the user's grasp of a selected one of the opposite ends of the tear strip member and wherein, the opposite ends of the tear strip member are disposed generally parallel to the outer angled face of the generally triangular shaped end segments.

* * * * *